US010646877B2

(12) United States Patent
Colson

(10) Patent No.: US 10,646,877 B2
(45) Date of Patent: May 12, 2020

(54) SYSTEM AND METHOD FOR ADJUSTING A MATERIAL BED DEPTH IN A PULVERIZER MILL

(71) Applicant: GENERAL ELECTRIC TECHNOLOGY GMBH, Baden (CH)

(72) Inventor: Paul Mackenzie Colson, Westfield, MA (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 415 days.

(21) Appl. No.: 15/457,106

(22) Filed: Mar. 13, 2017

(65) Prior Publication Data

US 2018/0257085 A1 Sep. 13, 2018

(51) Int. Cl.

*B02C 15/00* (2006.01)
*B02C 25/00* (2006.01)
*B02C 15/04* (2006.01)

(52) U.S. Cl.

CPC ..... *B02C 15/007* (2013.01); *B02C 15/001* (2013.01); *B02C 15/003* (2013.01); *B02C 15/045* (2013.01); *B02C 25/00* (2013.01); *B02C 2015/002* (2013.01)

(58) Field of Classification Search

CPC ..... B02C 25/00; B02C 15/001; B02C 15/045; B02C 15/2015; B02C 15/003; B02C 15/007

See application file for complete search history.

(56) References Cited

U.S. PATENT DOCUMENTS

| | | | | |
|---|---|---|---|---|
| 2,404,937 | A | 7/1946 | Anderson | |
| 4,489,895 | A * | 12/1984 | Petersen | B02C 15/007 241/119 |
| 4,869,434 | A * | 9/1989 | Folsberg | B02C 15/007 241/34 |
| 6,113,015 | A * | 9/2000 | Brundiek | B02C 15/04 241/121 |
| 7,252,253 | B2 | 8/2007 | Venkataramani | |
| 8,109,458 | B2 * | 2/2012 | Hanghoj | B02C 15/007 241/117 |
| 9,457,353 | B2 * | 10/2016 | Dunst | B02C 25/00 |
| 10,052,635 | B2 * | 8/2018 | Guerrero Palma | B02C 15/007 |
| 2014/0209719 | A1 * | 7/2014 | Dunst | B02C 15/007 241/25 |
| 2014/0231555 | A1 * | 8/2014 | Baetz | B02C 15/04 241/19 |

* cited by examiner

*Primary Examiner* — Faye Francis
(74) *Attorney, Agent, or Firm* — Grogan, Tuccillo & Vanderleeden, LLP

(57) ABSTRACT

A system for adjusting a depth of a material bed in a pulverizer mill is provided. The system includes a rotatable bowl, an extension ring, and an extension mechanism. The rotatable bowl has a surface operative to support the material bed while the bowl rotates such that particles of the material bed are pulverized against the surface by one or more grinding rollers of the pulverizer mill. The extension ring is disposed about a circumference of the rotatable bowl extending away from the surface and defines a depth of the material bed. The extension mechanism adjusts at least one of the extension ring and the rotatable bowl while the rotatable bowl rotates. Adjusting at least one of the extension ring and the rotatable bowl via the extension mechanism moves the extension ring in relation to the surface so as to adjust the depth of the material bed.

15 Claims, 5 Drawing Sheets

SYSTEM AND METHOD FOR ADJUSTING A MATERIAL BED DEPTH IN A PULVERIZER MILL

BACKGROUND

Technical Field

Embodiments of the invention relate generally to pulverizer mills, also referred to hereinafter simply as "mills," and more specifically, to a system and method for adjusting a depth of a material bed in a pulverizer mill.

Discussion of Art

Pulverizer mills are devices that size reduce a material up into particles. For example, many pulverizer mills grind solid fuels, e.g., coal, prior to combustion of the fuels in a furnace of a power plant. Many such mills grind solid fuels via grinding rollers that crush the fuels against a hard rotating surface known as a "bowl." The grinding rollers are attached to journal assemblies via bearings which allow the rollers to rotate. When a solid fuel is placed into the bowl, the rotation of the bowl causes the solid fuel to move under the grinding rollers, which in turn causes the grinding rollers to rotate in place. The journal assemblies also apply a downward force to the grinding rollers. Due to the downward force applied by the journal assemblies, the solid fuel is crushed/pulverized by the rollers.

The pulverized fuel then flows through a classifier which allows fine particles, i.e., particles that are at or below a maximum particle size, to flow out of the pulverizer mill, and restricts coarse particles, i.e., particles that are above the maximum particle size, from leaving the mill. The maximum size of particles allowed to flow/pass through a classifier is known as the "fineness" of the classifier, wherein a "high fineness" has a maximum particle size that is smaller than a "low fineness." In other words, the fineness of a classifier is a controlled distribution of the particles sizes allowed to flow out of the pulverizer mill.

In many mills, the solid fuel is first fed from a feeder via gravity onto a central region of the bowl known as the "table," and then allowed to centrifugally flow towards the outer circumference of the bowl as the bowl rotates. Many such pulverizer mills include a ring, known as an "extension ring," "dam ring," and/or "bowl ring," disposed along the outer edge of the bowl which has a first order influence on the depth of the bed formed by the solid fuel within the bowl, e.g., the greater or shorter the amount the ring extends away from the bowl, the deeper or shallower the depth of the fuel bed, respectively. Such extension rings, however, are presently fixed in place with respect to the bowl such that the amount the ring extends away from the bowl cannot be changed without shutting down the encompassing pulverizer mill, i.e., stopping rotation of the bowl, and exchanging out one extension ring for another. Thus, the depth of the material bed in present pulverizer mill designs is fixed, i.e., not adjustable, while the pulverizer mill is operating, i.e., while the bowl is rotating.

What is needed, therefore, is an improved system and method for adjusting the depth of a material bed in a pulverizer mill.

BRIEF DESCRIPTION

In an embodiment, a system for adjusting a depth of a material bed in a pulverizer mill is provided. The system includes a rotatable bowl, an extension ring, and an extension mechanism. The rotatable bowl has a surface operative to support the material bed while the bowl rotates such that particles of the material bed are pulverized against the surface by one or more grinding rollers of the pulverizer mill. The extension ring is disposed about a circumference of the rotatable bowl extending away from the surface and operative to define the depth of the material bed with respect to the surface. The extension mechanism is operative to adjust at least one of the extension ring and the rotatable bowl while the rotatable bowl rotates. Adjusting at least one of the extension ring and the rotatable bowl via the extension mechanism moves the extension ring in relation to the surface so as to adjust the depth of the material bed.

In another embodiment, a method of adjusting a depth of a material bed in a pulverizer mill is provided. The method includes supporting the material bed via a surface of a rotatable bowl while the bowl rotates such that particles of the material bed are pulverized against the surface by one or more grinding rollers of the pulverizer mill; and adjusting at least one of an extension ring and the rotatable bowl via an extension mechanism. The extension ring is disposed about a circumference of the rotatable bowl extending away from the surface and is moveable so as to define a depth of the material bed with respect to the surface. Adjusting at least one of the extension ring and the rotatable bowl via the extension mechanism moves the extension ring in relation to the surface.

In yet another embodiment, a non-transitory computer readable medium storing instructions is provided. The stored instruction are configured to adapt a controller of a pulverizer mill to: adjust at least one of an extension ring and a rotatable bowl via an extension mechanism, the rotatable bowl having a surface operative to support a material bed while the bowl rotates such that particles of the material bed are pulverized against the surface by one or more grinding rollers of the pulverizer mill, the extension ring disposed about a circumference of the rotatable bowl extending away from the surface so as to define a depth of the material bed with respect to the surface. Adjusting at least one of the extension ring and the rotatable bowl via the extension mechanism moves the extension ring in relation to the surface so as to adjust the depth of the material bed.

DRAWINGS

The present invention will be better understood from reading the following description of non-limiting embodiments, with reference to the attached drawings, wherein below:

Figure 1:
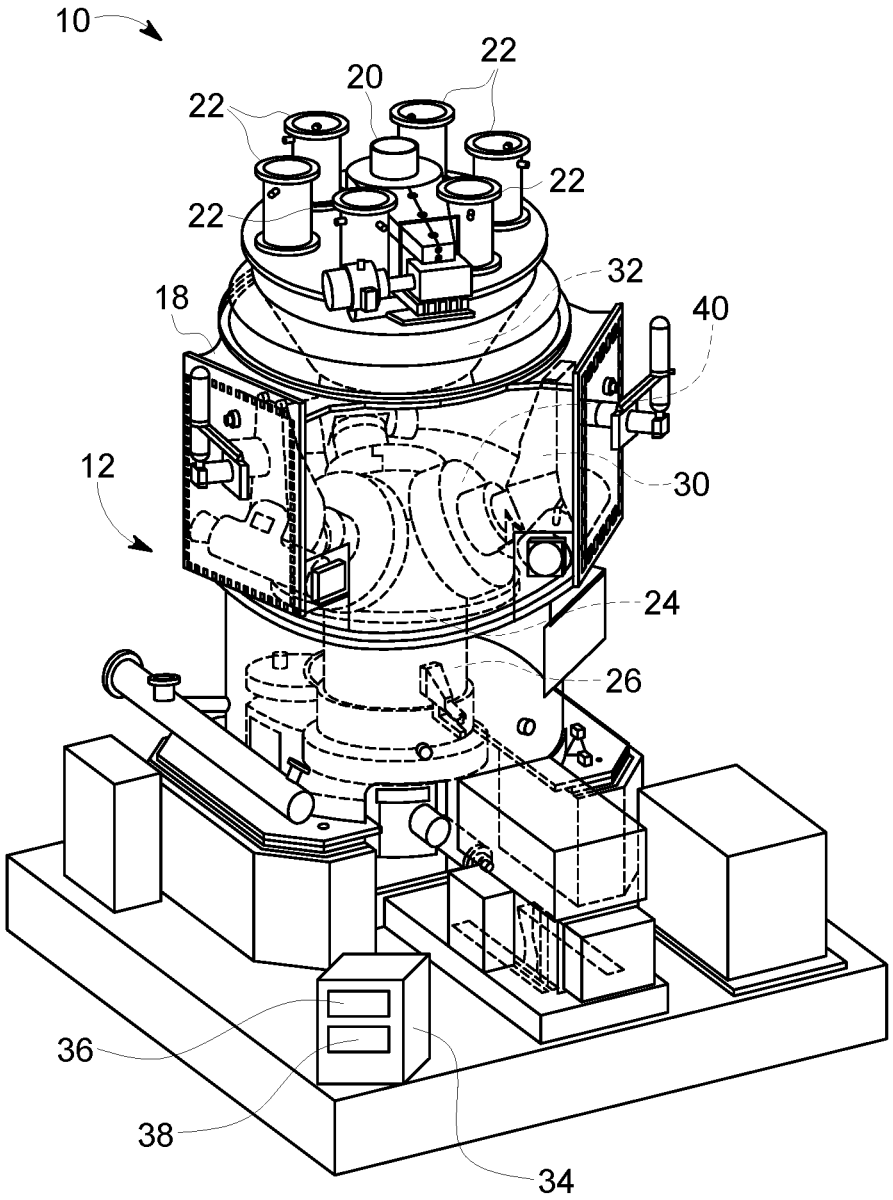
FIG. 1 is a perspective view of a system for adjusting a depth of a material bed in a pulverizer mill, in accordance with an embodiment of the invention.
Figure 6:
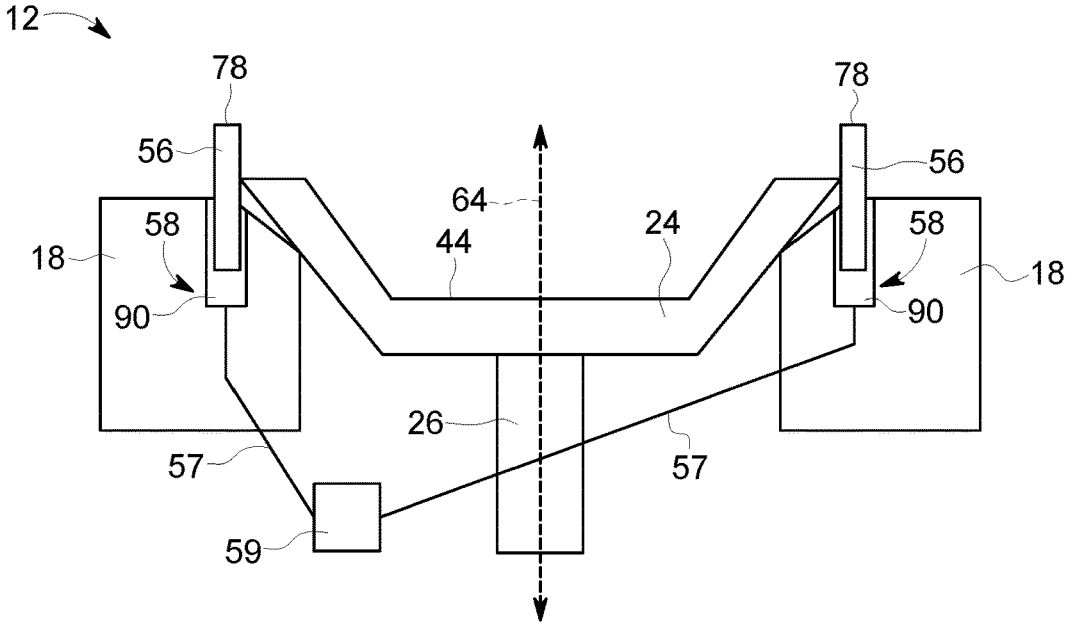
Figure 7:
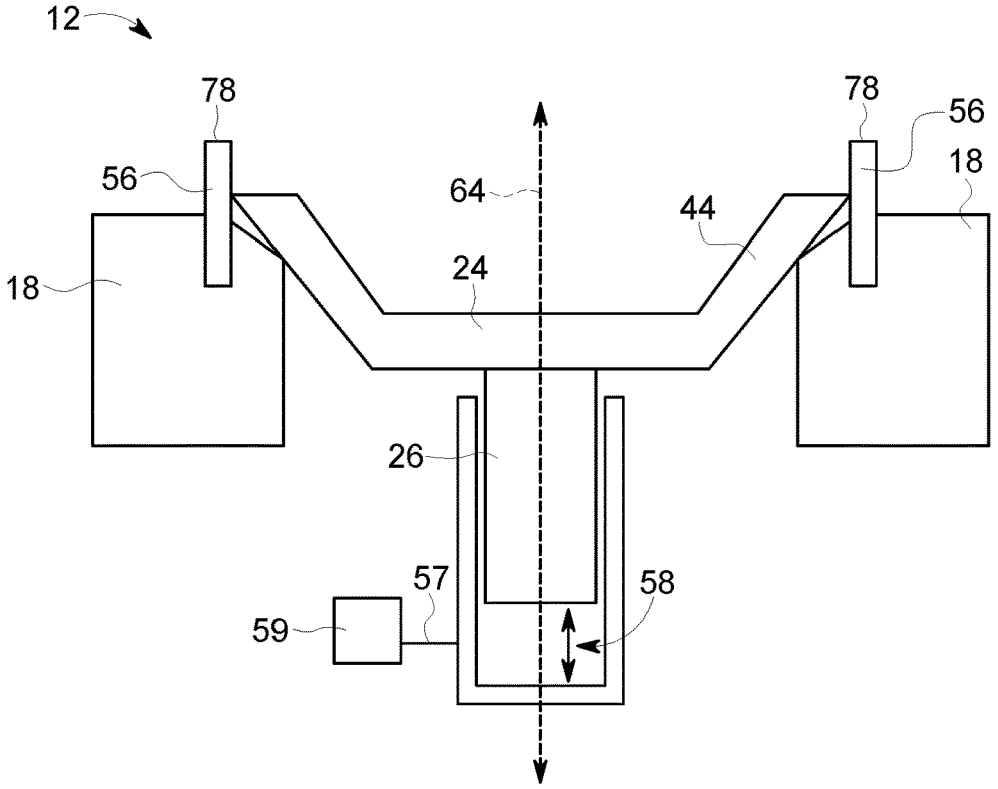

FIG. 6 is another cross-sectional view of a rotatable bowl, an extension ring, and an extension mechanism of the system of FIG. 1, wherein the extension ring is disposed on a body of the pulverizer mill and is adjusted by the extension mechanism, in accordance with an embodiment of the invention; and FIG. 7 is another cross-sectional view of a rotatable bowl, an extension ring, and an extension mechanism of the system of FIG. 1, wherein the extension ring is disposed on a body of the pulverizer mill and the rotatable bowl is adjusted by the extension mechanism, in accordance with an embodiment of the invention.

DETAILED DESCRIPTION

Reference will be made below in detail to exemplary embodiments of the invention, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly. The term "real-time," as used herein, means a level of processing responsiveness that a user senses as sufficiently immediate or that enables the processor to keep up with an external process. As used herein, "electrically coupled," "electrically connected," and "electrical communication" mean that the referenced elements are directly or indirectly connected such that an electrical current, or other communication medium, may flow from one to the other. The connection may include a direct conductive connection, i.e., without an intervening capacitive, inductive or active element, an inductive connection, a capacitive connection, and/or any other suitable electrical connection. Intervening components may be present. As also used herein, the term "fluidly connected" means that the referenced elements are connected such that a fluid (to include a liquid, gas, and/or plasma) may flow from one to the other. Accordingly, the terms "upstream" and "downstream," as used herein, describe the position of the referenced elements with respect to a flow path of a fluid and/or gas flowing between and/or near the referenced elements. Further, the term "stream," as used herein with respect to particles, means a continuous or near continuous flow of particles. As also used herein, the term "heating contact" means that the referenced objects are in proximity of one another such that heat/thermal energy can transfer between them. As also used herein, the term "mill pressure drop" refers to the difference in pressure between an interior of a housing of a pulverizer mill and the material/fuel outlet ducts of the pulverizer mill. The term "bowl pressure drop," as used herein, refers to the combined draft loss across a vane wheel and the material bed retained within the bowl of a pulverizer. The term "mill drive motor power level," as used herein, refers to the power required to rotate a bowl of an encompassing pulverizer mill. The term "classifier drive motor power level," as used herein, refers to the amount of power required to rotate a rotor of a classifier of a pulverizer mill. The term "primary air flow rate," as used herein, refers to the rate at which primary air is introduced into a housing of a pulverizer mill. Similarly, the term "primary air temperature," as used herein, refers to the temperature of the primary air when introduced into a housing of a pulverizer mill. As will be explained in greater detail below, the term "vibration level" refers to a measured amount of vibration within a bowl, grinder, journal assembly, and/or the extension ring of a pulverizer mill resulting from the pulverization of the particles of a material by the grinding rollers against a surface of the bowl. Similarly, the term "journal grinding force," as used herein, refers to the magnitude of a downward biasing force required to facilitate pulverization of a material by the grinding rollers of a pulverizer mill.

Additionally, while the embodiments disclosed herein are primarily described with respect to pulverizer mills, e.g., vertical spindle pulverizer mills, for solid fuel-based power plants, e.g., coal-based power plants, it is to be understood that embodiments of the present invention may be applicable to any apparatus and/or method that benefits from controlling the depth of a material bed within a rotatable/rotating bowl/surface.

Figure 2:
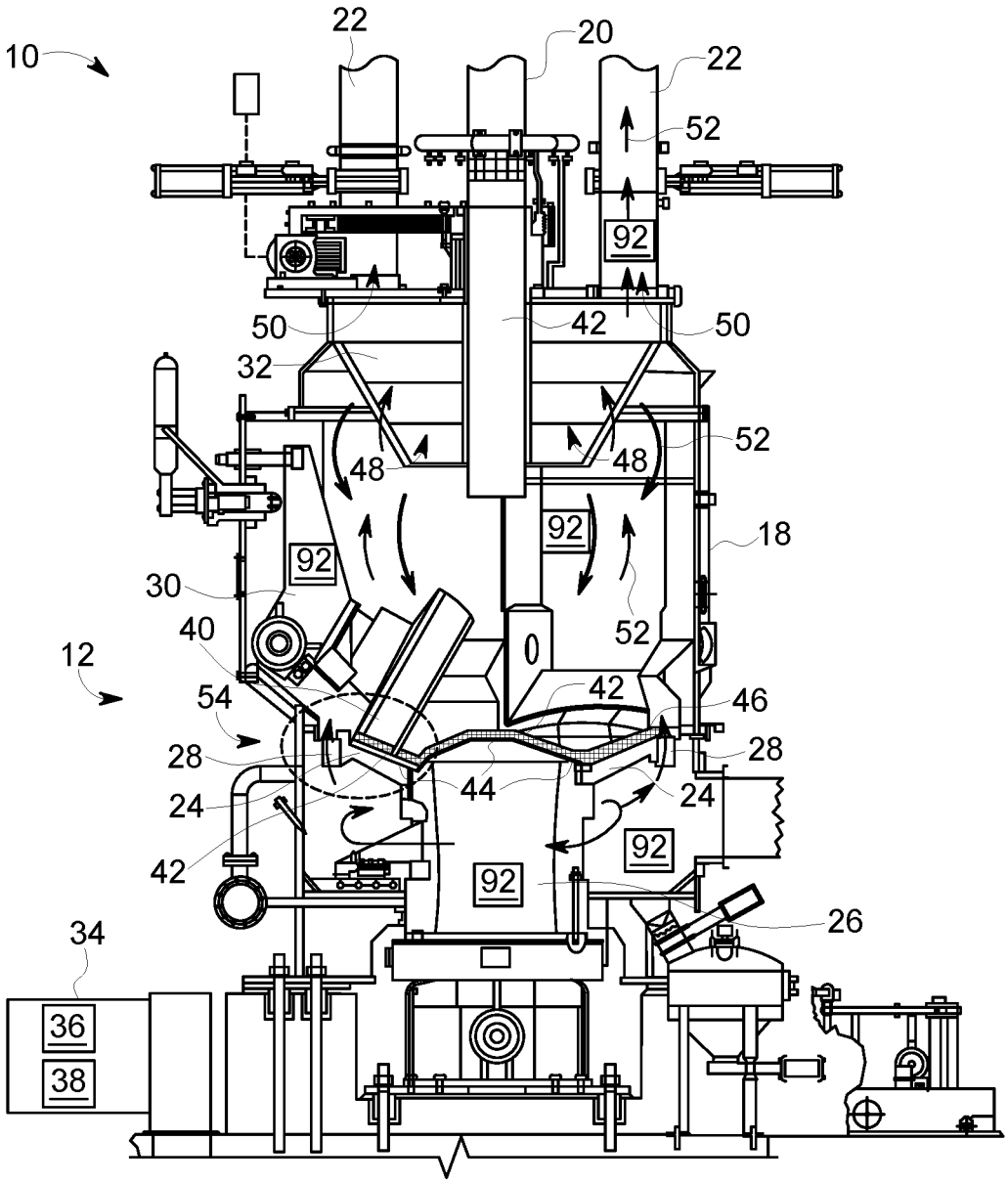
FIG. 2 is a cross-sectional view of the system of FIG. 1, in accordance with an embodiment of the invention.

Referring now to FIGS. 1 and 2, a pulverizer mill 10 incorporating a system 12 for adjusting a depth 14 (FIG. 3) of a material bed 16 (FIG. 3) in the pulverizer mill 10, in accordance with embodiments of the invention, is shown. The pulverizer mill 10 includes a housing 18, a fuel inlet duct 20, one or more fuel outlet ducts 22, a rotatable bowl 24 supported by a shaft or hub 26 turned by a motor (not shown), one or more air inlet ducts 28, at least one journal assembly 30, a classifier 32, and a controller 34 that includes at least one processor/CPU 36 and a memory device 38. The housing 18 contains the classifier 32, the rotatable bowl 24, and the journal assembly 30. The fuel inlet duct/pipe 20, the fuel outlet ducts 22, and the air inlet ducts 28 penetrate the housing 18 as shown in FIGS. 1 and 2. The journal assembly 30 is mounted to the interior of the housing 18 and includes a grinding roller/grinder 40 that is configured to grind particles of the material 42 (best seen in FIG. 3), e.g., coal, other solid fuels, and/or other materials suitable for being pulverized by the grinder 40, forming the material bed 16 against a surface 44 of the rotatable bowl 24.

As will be understood, during operation of the pulverizer mill 10, in accordance with embodiments of the invention, the material 42 is deposited onto the surface 44 of the rotatable bowl 24 via the fuel inlet duct 20. As the bowl 24 rotates, the material 42 centrifugally flows towards an outer edge/circumference 46 of the bowl 24 while also being forced under the grinder 40 such that a biasing force provided by a biasing component (not shown) of the journal assembly 30 enables the grinder 40 to crush/pulverize the particles of the material 42 against the surface 44 of the bowl 24. The air inlet ducts 28 blow forced air up through the housing 18 such that pulverized material 42 is forced against an upstream side 48 of the classifier 32 which allows fine particles of the material 42 to pass through to a downstream side 50 of the classifier 32. As will be understood, the upstream side 48 of the classifier 32 is the side of the classifier 32 that is exposed to the interior of the housing 18 and the downstream side 50 of the classifier 32 is the side of the classifier 32 that is exposed and/or fluidly connected to the fuel outlet ducts 22. Thus, as will be appreciated, the classifier 32 allows a stream of fine particles of the material 42 to flow from the upstream side 48 to the downstream side 50 and into the outlet ducts 22 for subsequent consumption/combustion by a furnace/boiler (not shown) and/or other process that consumes the pulverized material 42, while restricting the flow/stream of coarse particles from the upstream side 48 to the downstream side 50. As will be understood, the flow of the particles within the housing is represented by the arrows 52 (FIG. 2).

Figure 3:
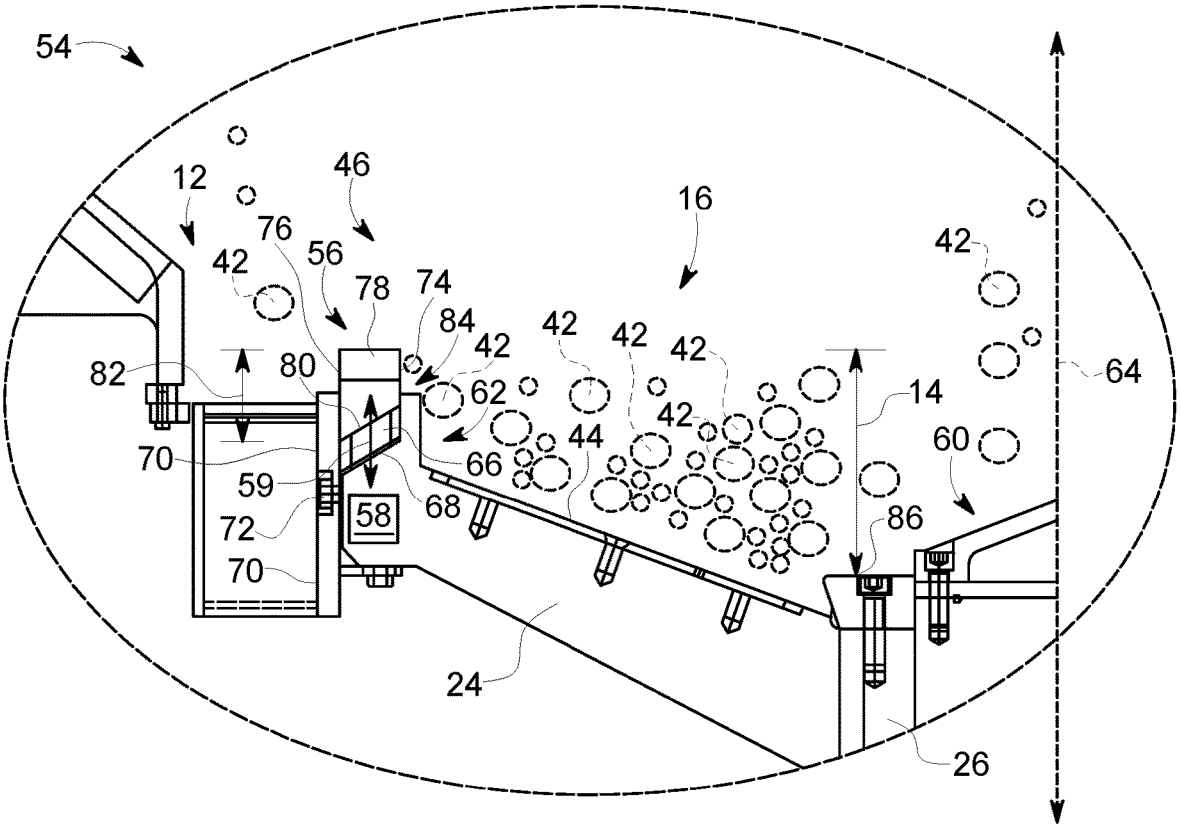
FIG. 3 is another cross-sectional view of the system of FIG. 1, in accordance with an embodiment of the invention.

Turning now to FIG. 3, a zoomed-in view of the region 54 in FIG. 2 is shown. The system 12 includes the rotatable bowl 24, an extension ring 56, and an extension mechanism 58. The extension ring 56 is disposed about the circumference 46 of the bowl 24 extending away from the surface 44 and is operative to affect the depth 14 of the material bed 16 with respect to the surface 44. As will be explained in greater detail below, the extension mechanism 58 is operative to adjust the extension ring 56 and/or the bowl 24 while the bowl 24 rotates. Thus, as will be appreciated, adjusting the extension ring 56 and/or the rotatable bowl 24 via the extension mechanism 58 moves the extension ring 56 in relation to the surface 44, e.g., in a vertical direction as indicated by arrows 59, so as to adjust the depth 14 of the material bed 16.

For example, as shown in FIG. 3, the bowl 24 may have a base/table 60 and/or a sidewall 62 formed by the surface 44, which supports the material bed 16 as the bowl 24 rotates about a central axis 64. While the surface 44 is depicted as being inclined from the table 60 to the sidewall 62, it will be understood that, in other embodiments, the surface 44 may be declined from the table 60 to the sidewall 62, or level therebetween. In embodiments, the bowl 24 may include a channel 66 for receiving the extension ring 56. In certain aspects, the channel 66 may be formed completely by the bowl 24, and/or, in embodiments, formed by a tapered surface 68 of the bowl 24 that abuts a vane wheel 70 secured to the rotatable bowl 24 via a fastener 72. As shown in FIG. 3, the vane wheel 70 may be secured to the bowl 24 below the channel 66.

The extension ring 56 has an interior surface 74, an exterior surface 76, a top surface 78, a bottom surface 80, and a thickness 82, i.e., the distance between the top 78 and bottom 80 surfaces. In certain aspects, the bottom surface 80 may be tapered such that it mirrors the tapered surface 68 of the bowl 24. As stated above, the extension ring 56 extends away from the surface 44 so as to define the depth 14 of the material bed 16. In other words, in embodiments, a portion 84 of the interior surface 74 extends beyond the surface 44, e.g., the sidewall 62, of the bowl 24, so as to retain the material bed 16 while excess particles of the material 42 are allowed to flow over the top surface 78 such that the depth 14 of the material bed 16 along any point 86 of the surface 44 remains relatively constant with respect to the vertical distance between the point 86 and the top surface 78. Accordingly, as the extension ring 56 moves in relation to the surface 44, the size of the portion 84 of the extension ring 56 that extends beyond the surface 44, e.g., the side wall 62, changes. Thus, the vertical distance between the top 78 of the extension ring 56 and the point 86 changes, which in turn changes the depth 14 of the material bed 16. Accordingly, in embodiments, the thickness 82 of the extension ring 56 may be between about 0.25-9.00 inches, the top 78 of the extension ring 56 may move with respect to the highest point of the surface 44 and/or bowl 24 in the vertical direction between about −1.00-8.75 inches, i.e., the extension ring 56 may extend beyond the top of the bowl 24 by about 8.75 inches and/or site below the top of the bowl 24 by about −1.00 inches, and the depth 14 of the material bed 16 may be between about 0.25-8.0 inches.

Figure 4:
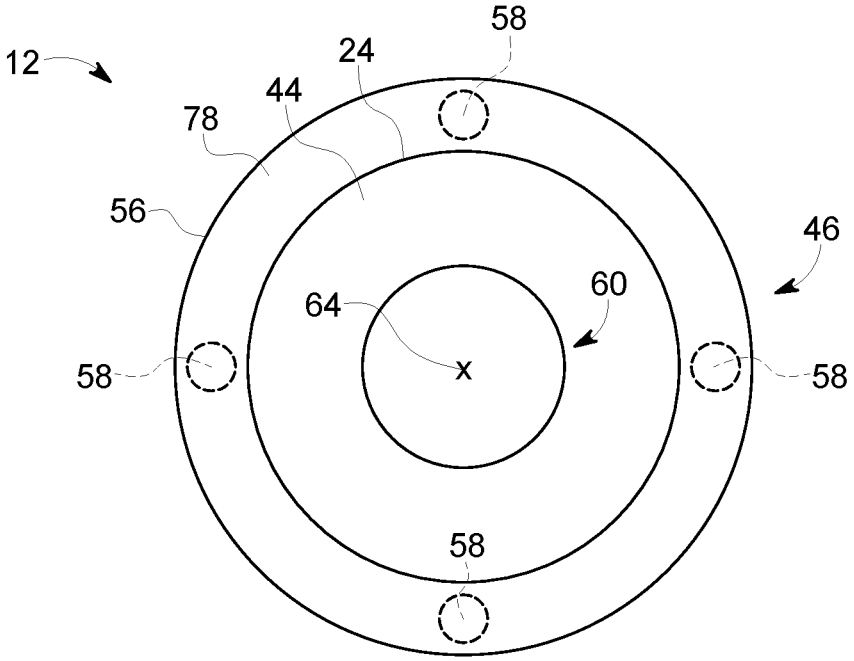
FIG. 4 is a top-down view of a rotatable bowl, an extension ring, and an extension mechanism of the system of FIG. 1, in accordance with an embodiment of the invention.
Figure 5:
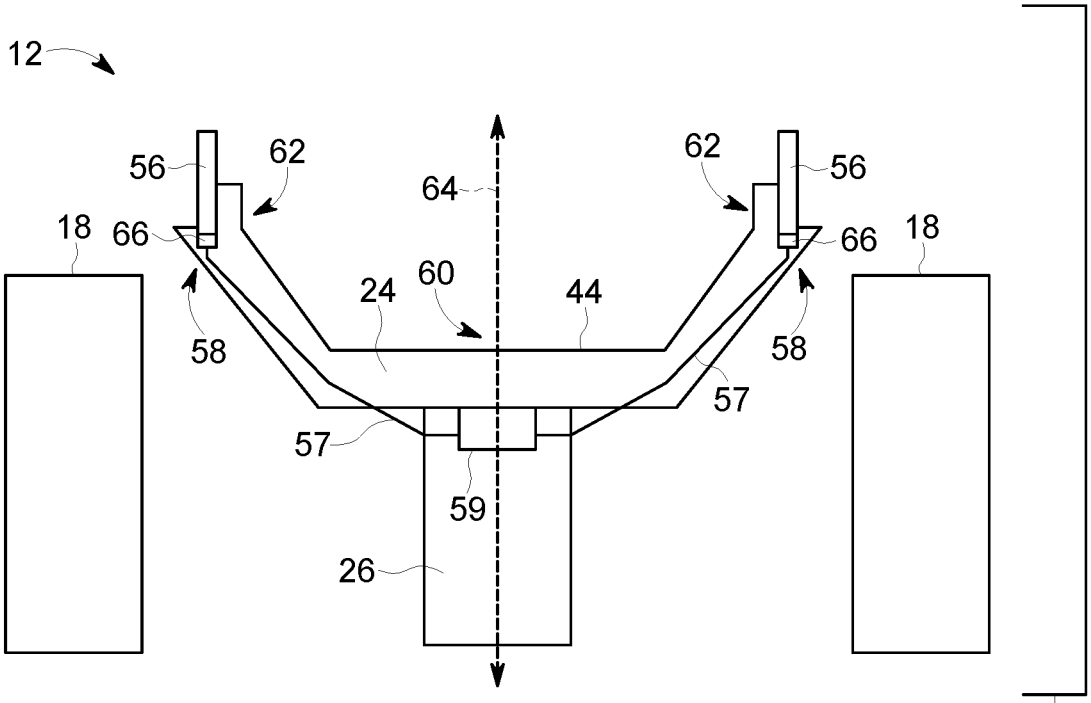
FIG. 5 is a cross-sectional view of a rotatable bowl, an extension ring, and an extension mechanism of the system of FIG. 1, wherein the extension ring is disposed on the rotatable bowl and is adjusted by the extension mechanism, in accordance with an embodiment of the invention.

As will be understood, the extension mechanism 58 may include one or more electric motors, as shown in FIG. 3, that drive one or more actuators, e.g., jacking screws, which may be spaced about the extension ring 56 as shown in FIG. 4. In embodiments, the extension mechanism 58 may include one or more hydraulic lifts and/or pneumatic lifts as shown in FIGS. 5-7, which may also be spaced about the extension ring 56 in a manner similar to the electric motors and jacking screws shown in FIG. 4. In embodiments, wherein the extension mechanism 58 is hydraulic and/or pneumatic based, a pump 59 (FIGS. 5, 6, and 7) may be disposed inside or outside of the bowl 24, the hydraulic/pneumatic lines 57 may run along the outside of the bowl 24 and travel along the exterior of the bowl 24, and one or more valves (not shown) may regulate the pressure in the lines 57 to move the bowl 24 or extension ring 56 as desired.

As further shown in FIGS. 5-7, the configuration of the bowl 24, extension ring 56, and extension mechanism 58 may vary. For example, shown in FIG. 5 is an embodiment of the system 12 in which the rotatable bowl 24 rotates in a fixed location with respect to the body/housing 18, and the extension mechanism 58 adjusts the extension ring 56 which is disposed on/in the bowl 24, e.g., in the channel 66. Moving to FIG. 6, an embodiment of the system 12 is shown in which the rotatable bowl 24 rotates in a fixed location with respect to the body/housing 18 and the extension mechanism 58 adjusts the extension ring 56, but where the extension ring 56 is disposed apart from the bowl 24, e.g., in a channel 90 disposed in the housing 18. Continuing to FIG. 7, another embodiment of the system 12 is shown in which the extension ring 56 is fixed in place with respect to the housing 18 and the extension mechanism 58 adjusts the rotatable bowl 24, e.g., the extension mechanism 58 may be a hydraulic piston and/or lift that moves the shaft 26 and bowl and/or hub 24 up and down with respect the top surface 78 of the extension ring 56.

Returning back to FIG. 2, as will be understood, the depth 14 (FIG. 3) of the material bed 16 (FIG. 3) may partially determine the efficiency of the encompassing pulverizer mill 10. In particular, increasing the depth 14 of the material bed 16 may increase the amount of power required to drive the shaft 26 and the bowl 24. Additionally, a 20% reduction in the depth 14 of the material bed 16 may improve the consistency of the fineness of the pulverized particles. The depth 14 of the material bed 16 may also affect the vibration level of the pulverizer mill 10. For example, in embodiments, the deeper the material bed 16 depth 14, the higher the vibration level. The depth 14 of the material bed 16 may also have similar effects on other operating parameters of the pulverizer mill 10.

Accordingly, the system 12 may further include the controller 34 which may be in electronic communication with the extension mechanism 58 (FIG. 3) and one or more sensors 92 disposed within the pulverizer mill 10 and/or an attached boiler (not shown), to include a sensor that provides feedback to the controller 34 regarding the position of the extension ring 56 and/or the bowl 24. In such embodiments, the controller 34 may adjust the depth 14 of the material bed 16 via the extension mechanism 58 based at least in part on data collected by the sensors 92 concerning various operating parameters of the pulverizer mill 10. As will be appreciated, such data may include/concern a mill pressure drop; a mill drive motor power level; a classifier drive motor power level; a material flow rate; a primary air flow rate; a primary air temperature; a vibration level; a desired material fineness; a moisture content of the material bed 16; a bowl pressure drop; a journal grinding force; and/or other operating parameters of the mill 10.

As such, the controller 34 may regulate the depth 14 of the material bed 16 so as to optimize the material flow rate while minimizing at least one of: the mill pressure drop; the mill drive motor power level; the classifier drive motor power level; the primary air flow rate; the vibration level; the journal grinding force; and/or any other operating parameter. For example, the controller 34 may adjust the depth 14 of the material bed 16 to be below or above a height corresponding to vibration threshold, i.e., a level of vibration considered to be detrimental to the operation of the pulverizer mill 10. As will be appreciated, the vibration threshold may be determined by the controller 34 based on the data received from the sensors 92.

Finally, it is also to be understood that the pulverizer mill 10 and/or the system 12 may include the necessary electronics, software, memory, storage, databases, firmware, logic/state machines, microprocessors, communication links, displays or other visual or audio user interfaces, printing devices, and any other input/output interfaces to perform the functions described herein and/or to achieve the results described herein, which may be performed/executed real-time. For example, as stated above, the pulverizer mill 10 may include at least one processor 36 and system memory/data storage structures 38 in the form of a controller 34. The memory may include random access memory ("RAM") and read-only memory ("ROM"). The at least one processor may include one or more conventional microprocessors and one or more supplementary co-processors such as math co-processors or the like. The data storage structures discussed herein may include an appropriate combination of magnetic, optical and/or semiconductor memory, and may include, for example, RAM, ROM, flash drive, an optical disc such as a compact disc and/or a hard disk or drive.

Additionally, a software application that provides for control over one or more of the various components of the pulverizer mill 10 and/or system 12, e.g., the extension mechanism 58, may be read into a main memory of the at least one processor from a computer-readable medium. The term "computer-readable medium", as used herein, refers to any medium that provides or participates in providing instructions to the at least one processor 36 (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random access memory ("DRAM"), which typically constitutes the main memory. Common forms of computer-readable media include, for example, a floppy disk, a flexible disk, hard disk, magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

While in embodiments, the execution of sequences of instructions in the software application causes the at least one processor to perform the methods/processes described herein, hard-wired circuitry may be used in place of, or in combination with, software instructions for implementation of the methods/processes of the present invention. Therefore, embodiments of the present invention are not limited to any specific combination of hardware and/or software.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

For example, in an embodiment a system for adjusting a depth of a material bed in a pulverizer mill is provided. The system includes a rotatable bowl, an extension ring, and an extension mechanism. The rotatable bowl has a surface operative to support the material bed while the bowl rotates such that particles of the material bed are pulverized against the surface by one or more grinding rollers of the pulverizer mill. The extension ring is disposed about a circumference of the rotatable bowl extending away from the surface and operative to define the depth of the material bed with respect to the surface. The extension mechanism is operative to adjust at least one of the extension ring and the rotatable bowl while the rotatable bowl rotates. Adjusting at least one of the extension ring and the rotatable bowl via the extension mechanism moves the extension ring in relation to the surface so as to adjust the depth of the material bed. In certain embodiments, the extension mechanism includes at least one of a hydraulic lift and a pneumatic lift. In certain embodiments, the extension mechanism includes at least one of an electric motor and a hydraulic motor. In certain embodiments, a vane wheel of the pulverizer mill is secured to the rotatable bowl. In certain embodiments, the rotatable bowl rotates in a fixed location with respect to a body of the mill, and the extension mechanism adjusts the extension ring. In certain embodiments, the extension ring is fixed in place with respect to a body of the mill, and the extension mechanism adjusts the rotatable bowl. In certain embodiments, the system further includes a controller operative to adjust the depth of the material bed via the extension mechanism based at least in part on data collected by one or more sensors disposed within the pulverizer mill and in electronic communication with the controller. In such embodiments, the data concerns at least one of: a mill pressure drop; a mill drive motor power level; a classifier drive motor power level; a material flow rate; a primary air flow rate; a primary air temperature; a vibration level; a desired material fineness; a moisture content of the material bed; a bowl pressure drop; and a journal grinding force. In certain embodiments, the controller is further operative to regulate the depth of the material bed so as to optimize the material flow rate while minimizing at least one of: the mill pressure drop; the mill drive motor power level; the classifier drive motor power level; the primary air flow rate; the vibration level; and the journal grinding force.

Other embodiments provide for a method of adjusting a depth of a material bed in a pulverizer mill. The method includes supporting the material bed via a surface of a rotatable bowl while the bowl rotates such that particles of the material bed are pulverized against the surface by one or more grinding rollers of the pulverizer mill; and adjusting at least one of an extension ring and the rotatable bowl via an extension mechanism. The extension ring is disposed about a circumference of the rotatable bowl extending away from the surface and is moveable so as to define a depth of the material bed with respect to the surface. Adjusting at least one of the extension ring and the rotatable bowl via the extension mechanism moves the extension ring in relation to the surface. In certain embodiments, the extension mechanism includes at least one of a hydraulic lift and a pneumatic lift. In certain embodiments, the extension mechanism includes at least one of an electric motor and a hydraulic motor. In certain embodiments, the bowl rotates in a fixed location with respect to a body of the mill, and the extension mechanism adjusts the extension ring. In certain embodiments, the extension ring is fixed in place with respect to a body of the mill, and the extension mechanism adjusts the bowl. In certain embodiments, adjusting at least one of an extension ring and the rotatable bowl via an extension mechanism is based at least in part on data received by a controller from a plurality of sensors disposed within the pulverizer mill. In such embodiments, the data concerns at least one of: a mill pressure drop; a mill drive motor power level; a classifier drive motor power level; a material flow rate; a primary air flow rate; a primary air temperature; a vibration level; a desired material fineness; a moisture content of the material bed; a bowl pressure drop; and a journal grinding force. In certain embodiments, adjusting at least one of an extension ring and the rotatable bowl via an extension mechanism includes: regulating the depth of the material bed so as to optimize the material flow rate while minimizing at least one of: the mill pressure drop, the mill drive motor power level, the classifier drive motor power level, the primary air flow rate, the vibration level, and the journal grinding force.

Yet still other embodiments provide for a non-transitory computer readable medium storing instructions. The stored instruction are configured to adapt a controller of a pulverizer mill to: adjust at least one of an extension ring and a rotatable bowl via an extension mechanism, the rotatable bowl having a surface operative to support a material bed while the bowl rotates such that particles of the material bed are pulverized against the surface by one or more grinding rollers of the pulverizer mill, the extension ring disposed about a circumference of the rotatable bowl extending away from the surface so as to define a depth of the material bed with respect to the surface. Adjusting at least one of the extension ring and the rotatable bowl via the extension mechanism moves the extension ring in relation to the surface so as to adjust the depth of the material bed. In certain embodiments, the stored instructions are further configured to adapt the controller to adjust at least one of the extension ring and the rotatable bowl based at least in part on data from a plurality of sensors disposed within the pulverizer mill. In such embodiments, the data concerns at least one of: a mill pressure drop; a mill drive motor power level; a classifier drive motor power level; a material flow rate; a primary air flow rate; a primary air temperature; a vibration level; a desired material fineness; a moisture content of the material bed; a bowl pressure drop; and a journal grinding force. In certain embodiments, the stored instructions are further configured to adapt the controller to: regulate the depth of the material bed so as to optimize the material flow rate while minimizing at least one of: the mill pressure drop, the mill drive motor power level, the classifier drive motor power level, the primary air flow rate, the vibration level, and the journal grinding force. In certain embodiments, the extension mechanism includes at least one of a hydraulic lift and a pneumatic lift. In certain embodiments, the extension mechanism includes at least one of an electric motor and a hydraulic motor.

Accordingly, by providing for adjustment of the extension ring and/or the bowl via the extension mechanism while the bowl rotates, some embodiments of the present invention provide for the ability to adjust the depth of the material bed during operation of the pulverizer mill, which may be accomplished independently of other operating parameters that may affect the depth of the material/fuel bed. Thus, some embodiments may provide for a 5-15% reduction in the mill drive motor power level over existing pulverizer mill and/or extension ring designs for the same material flow rate.

Further, active adjustment of the depth of the material bed during operation of the encompassing pulverizer mill, in some embodiments, may result in a decrease in mill pressure drop, which in turn reduces the amount of power required to control the air flow through the mill.

Further still, by maintaining an optimal material bed depth while the operating parameters of the encompassing mill change/fluctuate, some embodiments reduced the amount of time that a particular particle of material spends within the mill prior to exiting the mill at the desired fineness. Thus, some embodiments may reduce/mitigate the risk of explosive and/or other dangerous conditions occurring within the encompassing mill.

Yet further still, some embodiments of the invention may reduce wear on the various components of the encompassing pulverizer mill, e.g., the extension ring, journal assemblies, grinding rollers, etc., as compared to traditional extension ring and mill designs.

Yet further still, the ability to adjust the depth of the material bed without having to swap out the extension ring, provides for improved safety over existing designs as maintenance crew need not enter the pulverizer mill housing when a new material bed height is desired/required.

While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted as such, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

What is claimed is:

1. A system for adjusting a depth of a material bed in a pulverizer mill comprising:

a rotatable bowl having a surface operative to support the material bed while the bowl rotates such that particles of the material bed are pulverized against the surface by one or more grinding rollers of the pulverizer mill;

an extension ring disposed about a circumference of the rotatable bowl extending away from the surface and operative to define the depth of the material bed with respect to the surface;

an extension mechanism operative to adjust the extension ring while the rotatable bowl rotates; and wherein adjusting the extension ring via the extension mechanism moves the extension ring in relation to the surface of the rotatable bowl so as to adjust the depth of the material bed.

2. The system of claim 1, wherein the extension mechanism includes at least one of a hydraulic lift and a pneumatic lift.

3. The system of claim 1, wherein the extension mechanism includes at least one of an electric motor and a hydraulic motor.

4. The system of claim 1, wherein a vane wheel of the pulverizer mill is secured to the rotatable bowl.

5. The system of claim 1, wherein the rotatable bowl rotates in a fixed location with respect to a body of the mill, and the extension mechanism adjusts the extension ring.

6. The system of claim 1 further comprising:

a controller operative to adjust the depth of the material bed via the extension mechanism based at least in part on data collected by one or more sensors disposed within the pulverizer mill and in electronic communication with the controller, wherein the data concerns at least one of:

a mill pressure drop; a mill drive motor power level; a classifier drive motor power level; a material flow rate; a primary air flow rate; a primary air temperature; a vibration level; a desired material fineness; a moisture content of the material bed; a bowl pressure drop; and a journal grinding force.

7. The system of claim 6, wherein the controller is further operative to regulate the depth of the material bed so as to optimize the material flow rate while minimizing at least one of:

the mill pressure drop; the mill drive motor power level; the classifier drive motor power level; the primary air flow rate; the vibration level; and the journal grinding force.

8. The system of claim 1, wherein the extension mechanism includes at least one of a hydraulic lift and a pneumatic lift.

9. The system of claim 1, wherein the extension mechanism includes at least one of an electric motor and a hydraulic motor.

10. A system for adjusting a depth of a material bed in a pulverizer mill comprising:

a rotatable bowl having a surface operative to support the material bed while the bowl rotates such that particles of the material bed are pulverized against the surface by one or more grinding rollers of the pulverizer mill;

an extension ring disposed about a circumference of the rotatable bowl extending away from the surface and operative to define the depth of the material bed with respect to the surface;

an extension mechanism operative to adjust the extension ring, the extension mechanism including at least one of a hydraulic lift, a pneumatic lift, an electric motor, and a hydraulic motor; and wherein adjusting the extension ring via the extension mechanism moves the extension ring in relation to the surface so as to adjust the depth of the material bed.

11. The system of claim 10, wherein a vane wheel of the pulverizer mill is secured to the rotatable bowl.

12. The system of claim 11, wherein the rotatable bowl rotates in a fixed location with respect to a body of the mill, and the extension mechanism adjusts the extension ring.

13. The system of claim 12 further comprising:

a controller operative to adjust the depth of the material bed via the extension mechanism based at least in part on data collected by one or more sensors disposed within the pulverizer mill and in electronic communication with the controller, wherein the data concerns at least one of:

a mill pressure drop; a mill drive motor power level; a classifier drive motor power level; a material flow rate; a primary air flow rate; a primary air temperature; a vibration level; a desired material fineness; a moisture content of the material bed; a bowl pressure drop; and a journal grinding force.

14. The system of claim 13, wherein the controller is further operative to regulate the depth of the material bed so as to optimize the material flow rate while minimizing at least one of:

the mill pressure drop; the mill drive motor power level; the classifier drive motor power level; the primary air flow rate; the vibration level; and the journal grinding force.

15. A system for adjusting a depth of a material bed in a pulverizer mill comprising:

a rotatable bowl having a surface operative to support the material bed while the bowl rotates such that particles of the material bed are pulverized against the surface by one or more grinding rollers of the pulverizer mill;

an extension ring disposed about a circumference of the rotatable bowl extending away from the surface and operative to define the depth of the material bed with respect to the surface;

an extension mechanism operative to adjust the rotatable bowl while the rotatable bowl rotates; and wherein adjusting the rotatable bowl via the extension mechanism moves the surface of the rotatable bowl in relation to the extension ring so as to adjust the depth of the material bed.

* * * * *